US011624227B2

(12) United States Patent
Didio

(10) Patent No.: US 11,624,227 B2
(45) Date of Patent: Apr. 11, 2023

(54) SAFETY EYE LIGHT APPARATUS AND METHODS OF USE

(71) Applicant: Christopher T. Didio, Macomb, MI (US)

(72) Inventor: Christopher T. Didio, Macomb, MI (US)

( * ) Notice: Subject to any disclaimer, the term of this patent is extended or adjusted under 35 U.S.C. 154(b) by 231 days.

(21) Appl. No.: 16/846,286

(22) Filed: Apr. 11, 2020

(65) Prior Publication Data

US 2020/0325717 A1 Oct. 15, 2020

Related U.S. Application Data

(60) Provisional application No. 62/832,698, filed on Apr. 11, 2019.

(51) Int. Cl.
*E05F 15/43* (2015.01)
*F21V 33/00* (2006.01)

(52) U.S. Cl.
CPC ..... *E05F 15/43* (2015.01); *F21V 33/006* (2013.01); *E05F 2015/436* (2015.01)

(58) Field of Classification Search
CPC ..... E05F 15/43; F21V 33/006
See application file for complete search history.

(56) References Cited

U.S. PATENT DOCUMENTS 5,934,019 A * 8/1999 Rotharmel ..... E05F 15/43 49/28
2018/0209199 A1* 7/2018 Liu ..... E05F 15/668

* cited by examiner

*Primary Examiner* — Thomas M Sember
(74) *Attorney, Agent, or Firm* — Device Patent LLC

(57) ABSTRACT

Garage door opening systems commonly include lighting generated from lower wattage bulbs mounted to an electric operator near a garage ceiling. This lighting is inadequate to fully illuminate a garage space particularly at the floor level. Since vehicles park under the light, the vehicle can become a blocker of light. Disclosed are garage door opening systems including a safety eye light which integrates a light source into the safety eye of a garage door opening system thereby providing additional illumination to poorly lit areas of a garage. This additional source of lighting helps assure users safer home to vehicle ingress and egress. In some forms, the lights in the safety eye light are fixed, in other forms the lights are adjustable in direction. Various methods of integrating a safety eye light into a garage door opening system and use of the safety eye light are disclosed herein.

20 Claims, 6 Drawing Sheets

SAFETY EYE LIGHT APPARATUS AND METHODS OF USE

This application claims priority to Provisional Patent Application No. 62/832,698 filed Apr. 11, 2019, the entire disclosure of which is hereby incorporated by reference and relied upon.

BACKGROUND OF THE INVENTION

Field of the Invention

The invention relates generally to safety lighting, and more particularly to garage safety lighting.

Overhead lighting secured to the ceiling of a garage is the most common type of garage lighting today. It is typically activated by a wall switch located near a standard hinged door of a garage. The wall switch is obviously well out of reach for a homeowner driving their vehicle into the garage for parking making the overhead lighting unavailable when needed. In addition, these ceiling mounted lights are typically poor illuminators of garages at the floor level where people move about. Regardless, the ceiling mounted lights are useless during parking since homeowners typically turn them off when leaving the home.

Most quality garage door openers include lights. Since garage door openers tend to be mounted overhead and typically utilize lower watt bulbs, they too are typically poor illuminators of garages at the floor level. In addition, lights on garage door openers are typically lower lumen and directed in a direction that illuminates parallel to the ceiling they are mounted to as illustrated in the prior art examples of FIG. 2. However, since vehicles are typically parked directly under the garage door opener light, the vehicle itself become a blocker of light letting little light fall upon the floor at the sides of the vehicle. Many prior garage door openers with a light do however have the benefit of at least automatically turning on when the associated garage door is opened or closed.

What is needed are convenient and improved lighting systems for garages that illuminate a garage floor and surrounding areas to enable users to safely move their vehicle in and out of the garage, and safely ambulate about the garage and in and out their home especially when carrying loads such as groceries. What is needed is better garage lighting for homeowners to expose obstacles on or near a garage floor that may be a danger due to tripping and falling, as well as to brightly expose perpetrators who may intend to rob or cause physical harm to a homeowner. What is needed are garage lighting systems that can be activated remotely.

SUMMARY OF THE INVENTION

A pair of opposed safety eyes, first safety eye 106 and second safety eye 108, are commonly positioned near floor level with each secured to a respective first vertical rail 102 and second vertical rail 104 of a garage door opening system, or alternatively to a first vertical frame 103 and second vertical frame 105 as illustrated in FIG. 1. The opposed safety eyes operate by use of an infrared beam 110 of light that is emitted from a first safety eye 106 mounted at one side of the garage door entry towards the second safety eye 108 mounted at the opposed garage door entry. One of the first safety eye and second safety eye is a sending unit (emitting the infrared beam) and the other is a receiving unit (sensing the incoming infrared beam). As long as the infrared beam 110 of light is not interrupted by an obstacle, the garage door should operate without interruption. However, when the infrared beam of light is interrupted by an obstacle (i.e. a bicycle or a small child), the associated garage door opener will not allow the garage door to fully close thereby preventing injury to the child, bicycle, or other obstacle blocking the infrared light beam. This safety feature protects both human life and other obstacles from being crushed by a lowering garage door. Safety eyes are typically mounted near the ground, about 4 inches from the floor however this distance may vary. As an improvement to the safety eyes found in the prior art, disclosed herein are safety eyes for safety eye light systems that comprise one or more safety lights integrated or extending from the body of a safety eye module and referred herein as a safety eye light. Also disclosed are garage door systems utilizing safety eye lights and related methods.

In one form, a safety eye light comprises at least one of an opposed infrared sending unit and infrared receiving unit, and one or more safety lights for illuminating a space. In this disclosure, safety light refers a light having a visible spectrum of light commonly used to illuminate a space.

In one form, a safety light on a safety eye light utilizes at least one of: a LED, incandescent, halogen, and fluorescent light source.

In one form, a safety light on a safety eye light is disposed on any one side of an eye-light body of a safety eye light.

In one form, the eye-light body comprises a medial face on a medial facing side.

In one form, the eye-light body comprises a front face on a front facing side.

In one form, the eye-light body comprises a lateral facing side.

In one form, the eye-light body comprises a top facing side.

In one form, the eye-light body comprises a bottom facing side.

In one form, a safety light is disposed on one or more of a front face and a medial face of an eye-light body.

In one form, a safety eye light comprises a single safety light.

In one form, a safety eye light comprises a plurality of safety lights.

In one form, light emitted from a safety eye light is motion activated.

In one form, activation of a safety light within a safety eye light is consequent to opening or closing of a garage door.

In one form, activation of a safety light is consequent to movement of a vehicle in or out of a garage.

In one form, activation of a safety eye light is consequent to motion occurring within a garage such as a person walking.

In one form, a safety eye light comprises a motion detector unit for sensing motion within a predetermined space such as a garage.

In one form, a safety light on a safety eye light once activated remains illuminated for a pre-set amount of time.

In one form, a safety light on a safety eye light is illuminated by activating an activation button mounted on a wall.

In one form, a safety light on a safety eye light is illuminated by activating an activation button on a handheld controller.

In one form, illuminating a safety light on a safety eye light by activating an activation button mounted on at least one of: a wall and on a handheld controller causes consequent continual illumination until actively deactivating the safety light.

In one form, illuminating a safety light by activating a button mounted on a wall or on a handheld controller results in a consequent timed illumination after which the safety light turns off without user intervention.

In one form, a safety light within a safety eye light has an axis of illumination that is directionally adjustable.

In one form, at least one safety light within a safety eye light is pivotably adjustable to direct light in a predetermined direction.

In one form, at least one safety light within a safety eye light is in a fixed direction.

In one form, a safety eye light comprises a plurality of safety lights adjustable to different directions.

In one form, a safety eye light comprises at least two safety lights each directed along divergent axes.

In one form, a safety eye light comprises at least two safety lights each directed along parallel axes.

In one form, the beam width from a safety light in a safety eye light is adjustable.

In one form, one or more safety eye lights is mounted adjacent a vertical garage door rail.

In one form, a safety light of a safety eye light is positioned to illuminate at the floor level at the rear of vehicles.

In one form, a safety light is positioned to illuminate at the rear of vehicles in a garage and down the exterior sides of the vehicles where occupants enter and exit.

In one form, a safety light is integrated in a garage door opener safety eye component.

In one form, a safety light is an automatic function that runs continuously to supply illumination for safety at the floor level.

In one form, a safety eye light supplies light to the back and sides of the garage at the floor level for safety.

In one form, a safety eye light comprises a battery compartment for enclosing a battery therein.

In one form, the safety light within a safety eye light is battery powered.

In one form, a safety eye light comprises a wireless control sensor operable to receive wireless signals from a sending unit on one or more of: an overhead garage door opener, and a remote control causing consequent on/off control of a safety light on the safety eye light.

In one form, a button on a key chain garage door opener remote control is pre-programmed to cause when depressed consequent activation of a safety light on a safety eye light though a wireless signal transmitted from the remote control.

In one form, a button on a visor garage door opener remote control is pre-programmed to cause when depressed consequent activation of a safety light on a safety eye light though a wireless signal transmitted from the remote control.

In one form, a button on a key chain garage door opener remote control is programmable to cause when depressed consequent activation of a safety light on a safety eye light though a wireless signal transmitted from the remote control.

In one form, a button on a visor garage door opener remote control is programmable to cause when depressed consequent activation of a safety light on a safety eye light though a wireless signal transmitted from the remote control.

In one form, a safety light is included on both of the opposing safety eye light modules (eye-light body).

In one form, a safety light is included on only one of the opposing safety eye light modules.

In one form, a safety light of a safety eye light is directed towards one or more of the side walls of a space such as a garage.

In one form, a safety light of a safety eye light is directed to spread towards both the side walls and floor of a space such as a garage.

In one form, safety light(s) of a first safety eye light have different illumination directions than safety light(s) on a second safety eye light.

In one form, safety light(s) of a first safety eye light are directionally adjustable to have different illumination directions that safety light(s) on a second safety eye light.

In one form, a safety eye light utilizes a mount bracket for securing a safety eye light to a vertical rail of a common garage door opening system.

In one form, the mount bracket is fastened to the vertical rail.

In one form, the mount bracket has slotted fastener holes operable to facilitate bracket positioning, mounting, and alignment with an opposed safety eye light.

In one form, the mount bracket comprises a C-shaped deflectable clamp operable to secure to a vertical rail by friction.

In one form, a safety eye light utilizes a mount bracket operable to secure the safety eye light to a vertical frame or wall of a space using fasteners.

In one form, a safety eye light utilizes a wall or rail bracket having a bendable arm for directing the illumination path of a safety light of a safety eye light.

In one form, one embodiment of a method of operating a safety light on a safety eye light comprises the following steps. A user programs a button referred to as 'X' on a remote control associated with a garage door opener (or alternately the button my be pre-programmed). The remote control may be in a variety of forms including: a key chain remote, a visor remote, a remote integrated into a vehicle, and an indoor/outdoor wall mounted remote. The user presses button 'X' on the associated remote indicating to turn on/off a safety light of a safety eye light associated with the garage door opener. The wireless signal from the remote activated by button 'X' is received by a receiver located in the garage door electric operator causing consequent opening or closing of a power line switch powering the safety light in the safety eye light. The safety light turns on/off. Alternatively, the garage door opener sends a wireless signal to a wireless control sensor on the safety eye light causing consequent activation/deactivation of the safety light.

In one form, one embodiment of a method of operating a safety light on a safety eye light comprises the following steps. The user presses a button on a remote control associated with a garage door opener. Again, the remote control may be in a variety of forms including a key chain remote, a visor remote, a remote integrated into a vehicle, and an indoor/outdoor wall mounted remote. The signal from the remote is received by a receiver in the garage door opener. This causes a consequent action by the opener of closing a power line switch thereby powering the safety eye light(s) and activating the garage door opener to raise or lower the garage door. Alternatively, the garage electric operator may send a wireless signal to wireless control sensor on the eye-light body thereby activating the safety light to turn on or off. When complete, the safety eye light turns off or may be timed delayed allowing for example an occupant time to walk into their home.

In one form, one embodiment of a method of operating a safety light on a safety eye light comprises the following steps. A safety eye of a safety eye light senses a break in the infrared light beam transmitted between opposed safety eyes of a first safety eye light and a second safety eye light. A safety eye signal is sent to the garage electric operator causing the power to be sent from the garage door opener to the safety light on the safety eye light. Alternatively, the electric operator sends a wireless signal to a wireless control sensor on the safety eye light to turn it on.

BRIEF DESCRIPTION OF THE SEVERAL VIEWS OF THE DRAWINGS

These and other features and advantages of the present invention will become more readily appreciated when considered in connection with the following detailed description and appended drawings, wherein each drawing is according to one or more embodiments shown and described herein, and wherein.

DETAILED DESCRIPTION OF SELECTED EMBODIMENTS OF THE INVENTION

Select embodiments of the invention will now be described with reference to the Figures. Like numerals indicate like or corresponding elements throughout the several views and wherein various embodiments are separated by letters (i.e. 100A, 100B, 100C). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Figure 1:
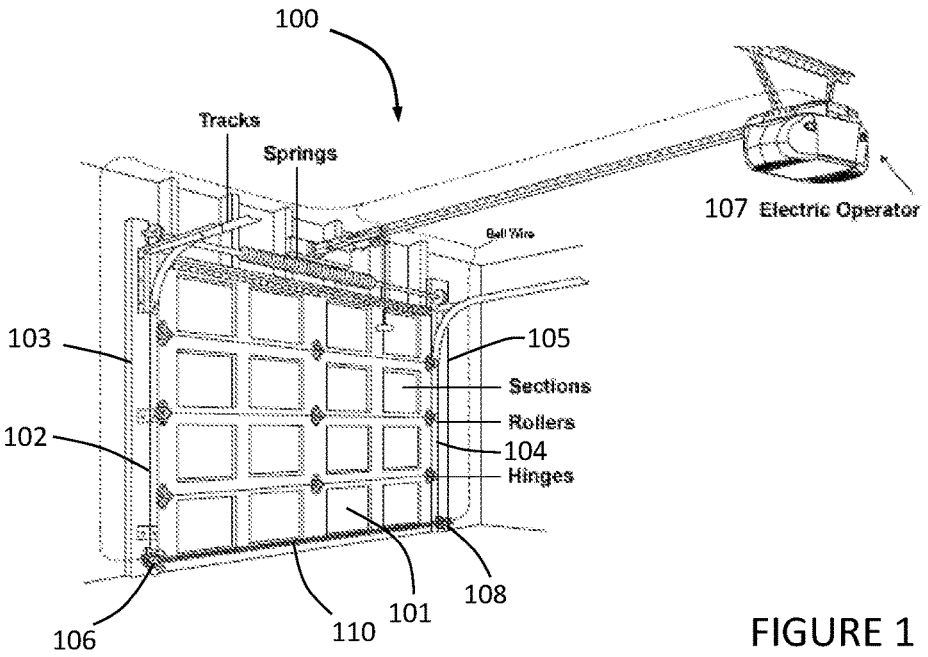
FIGURE 1 PRIOR ART
FIG. 1 depicts a perspective view of a garage door and garage door opening system as found in the prior art.
Figure 2:
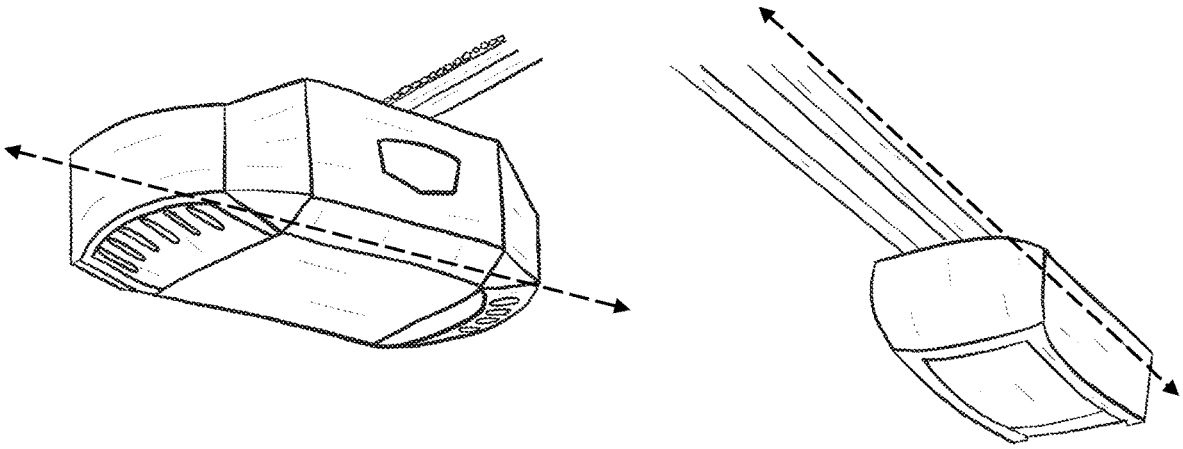
FIGURE 2 PRIOR ART
FIG. 2 depicts perspective views of various forms of garage door electric operators illustrating the common direction of light illuminated from them.
Figure 17:
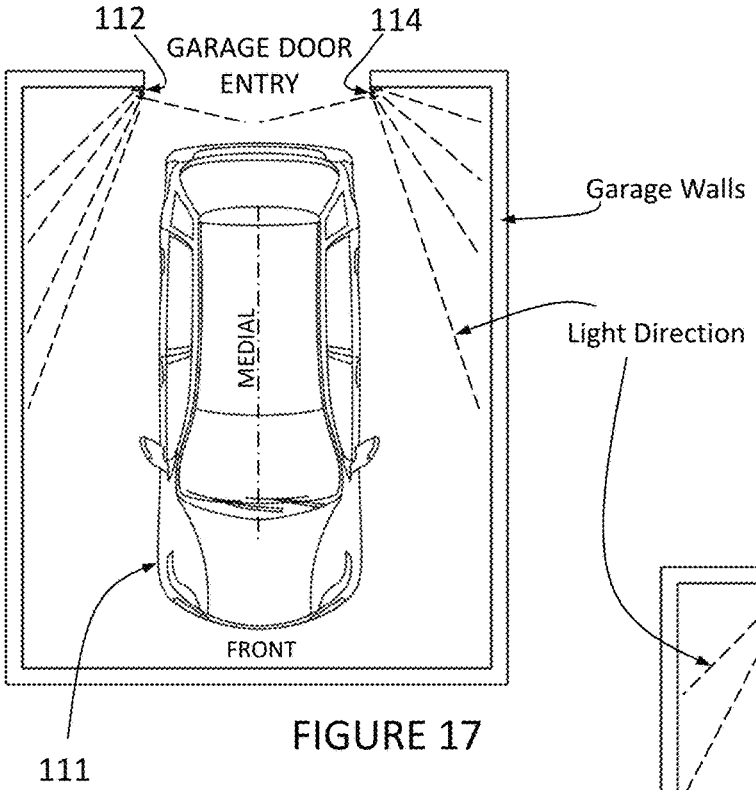
FIG. 17 depicts an overhead view of one embodiment of directional lighting across a floor in a garage space.
Figure 18:
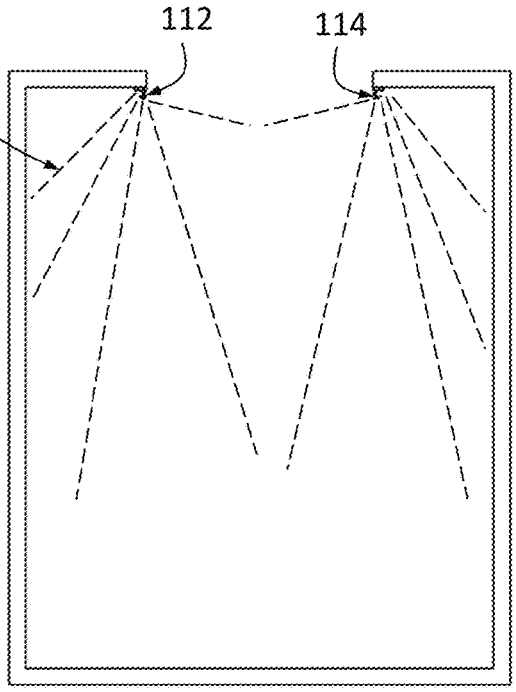
FIG. 18 depicts an overhead view of one embodiment of directional lighting across a floor in a garage space.
Figure 19:
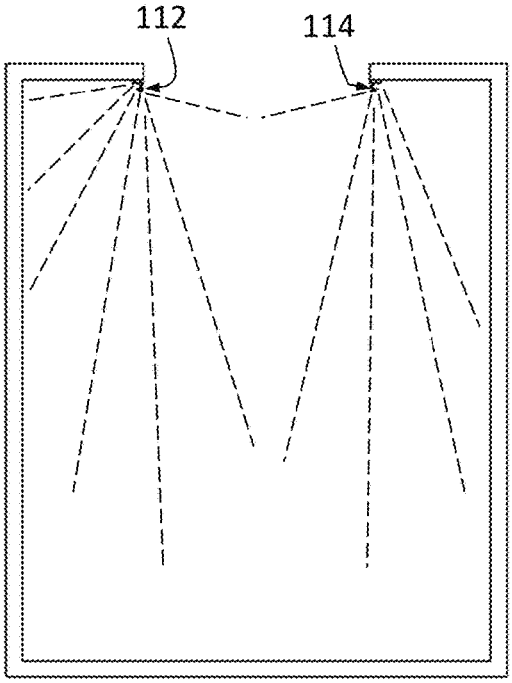
FIG. 19 depicts an overhead view of one embodiment of directional lighting across a floor in a garage space.

Like the safety eyes illustrated in FIG. 1, a first safety eye light 112 is mounted on one side of a garage door entry with an opposed second safety eye light 114 mounted on an opposed side of a garage door entry as illustrated in FIGS. 17-19. The safety eye 116 (as illustrated in various embodiments) of the first safety eye light 112 and the second safety eye light 114 are positioned to face each other along an axis extending therebetween. When powered, an infrared beam extends between the opposed safety eyes 116 whereas one safety eye is in the form of an infrared light sending unit and the other an infrared light receiving unit. At least one of first safety eye light 112 and second safety eye light 114 comprise a safety light. However, in preferred embodiments, both of the first safety eye light 112 and second safety eye light 114 assemblies comprise one or more safety lights (i.e. first safety light 118, second safety light 120, third safety light 122) for illuminating a space. This is illustrated further in upcoming embodiments.

Figure 3:
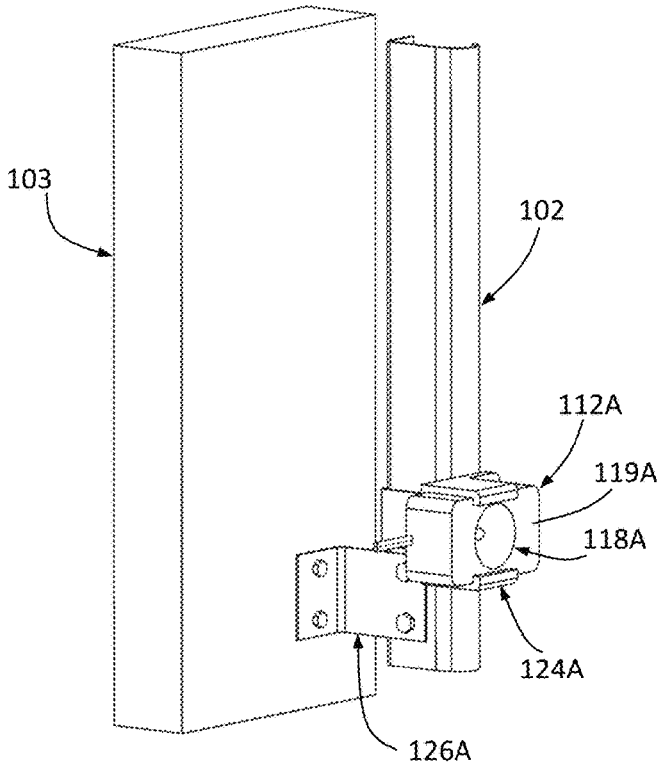
FIG. 3 depicts a partial perspective view of one embodiment of a first safety eye light mounted to a vertical rail of a garage door by a mount bracket.
Figure 4:
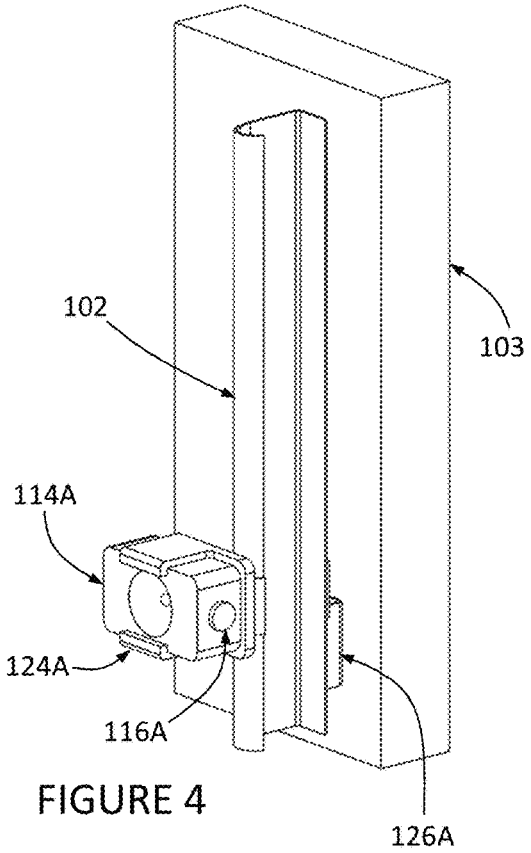
FIG. 4 depicts an opposing partial perspective lateral view of the safety eye light of FIG. 3.
Figure 5:
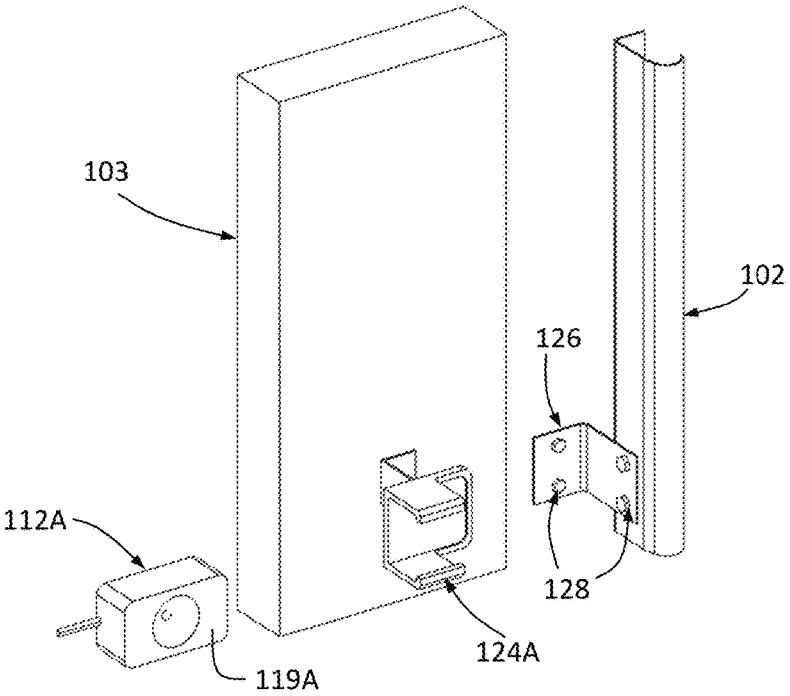
FIG. 5 depicts an exploded perspective view of the safety eye light, mount bracket, and vertical rail of the garage door of FIG. 3.

FIGS. 3 and 4 illustrate a partial view of one embodiment of a first safety eye light 112A and a second safety eye light 114A secured in place by a mount bracket 124A at a side of a garage door entry. In this embodiment, first safety eye light 112A comprises a fixed direction first safety light 118A on front face 119A. One or more rail brackets 126A are commonly used to secure the first vertical rail 102 and second vertical rail 104 to a wall or frame of a garage such as first vertical frame 103 (FIG. 1). FIG. 5 further illustrates an exploded view of this assembly. Fasteners 128A are commonly utilized for securing the mount bracket 124A and rails.

FIGS. 6-10 illustrate just some of the various embodiments of first (or second) safety eye lights referred generically as a safety eye light. Each safety eye light 112 comprises an eye-light body 113 which may have any variety of forms but illustrated here as substantially boxed shaped. Disposed within the eye-light body 113 at a first end (usually a medial face) is a safety eye 116 which is one of a sending or receiving infrared light variety. Some embodiments of safety eye lights include a wireless control sensor 130 for receiving wireless electronic signals sent from a wireless garage door opener for activation or deactivation of a safety light on one of the first or second safety eye lights 112, 114. Standard safety eyes typically utilize wired communication 132 to provide power to the safety eye 116 sensors. However, the wired communication 132 may also be used to route power from the garage door opener (electric operator) to one or both of first safety eye light 112 and second safety eye light 114 to power the respective safety lights thereon. In some embodiments, the eye-light body 113 comprises a motion sensor 134 operable to sense motion within a space such as a garage for motion sensing activation of the safety light. As noted in all embodiments, disposed in or extending from eye-light body 113 is a first safety light 118 and in some embodiments a plurality of safety lights (i.e. second safety light 120, third safety light 122, etc.). Various embodiments are distinguished by the suffix A, B, C etc.

Figure 6:
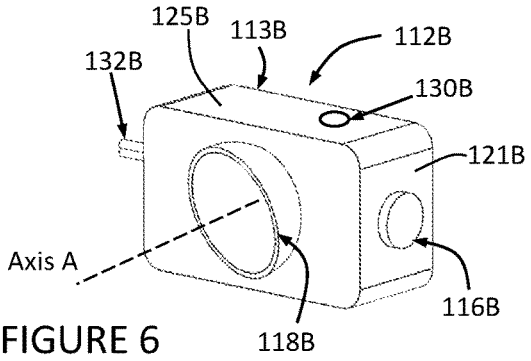
FIG. 6 depicts a perspective view of a safety eye light comprising a directionally adjustable safety light.
Figure 7:
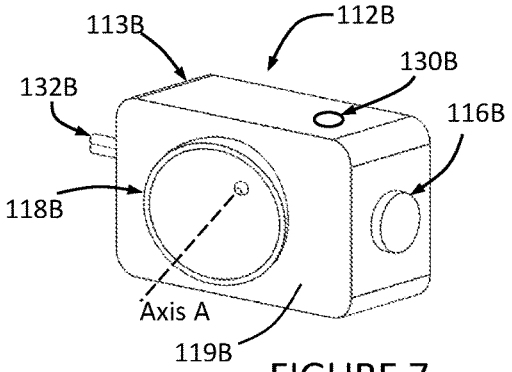
FIG. 7 depicts a perspective view of the safety eye light of FIG. 6 whereas the directionally adjustable safety light is directed in a different direction.

FIGS. 6 and 7 illustrate views of one embodiment of a first safety eye light 112B comprising a first safety light 118B having an axis of illumination (Axis A) that is directionally adjustable. In this case, the directionally adjustable safety light is pivotably adjustable to direct light in a predetermined direction. Friction holds the first safety light 118B in a predetermined position after being pivoted by a user. As noted in FIG. 7, first safety light 118B has been pivoted to a different position and therefore the axis of illumination points in a different direction. Note also that the pivoting motion provides movement not only left and right, but also up and down thereby providing the user the ability to adjust light focus closer or further away. In some embodiments, the directionally adjustable safety lights are adjustable in a single plain for adjustment in medial-lateral directions. In alternative embodiments, a safety eye light comprises a plurality of safety lights each adjustable to a different direction.

Figure 8:
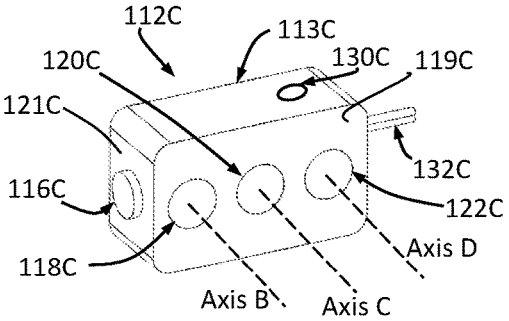
FIG. 8 depicts a perspective view of a safety eye light comprising a plurality of fixed safety lights directed in generally the same direction.
Figure 9:
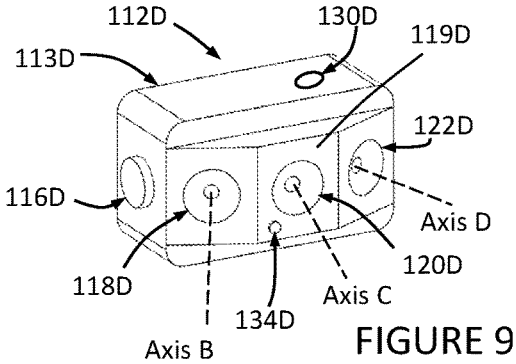
FIG. 9 depicts a perspective view of a safety eye light comprising a plurality of fixed safety lights directed in two or more directions.

FIGS. 8 and 9 illustrate embodiments of safety eye lights 112 having safety lights that are fixed in a predetermined direction as noted by Axis B, Axis C, and Axis D. In the FIG. 8 embodiment, the first/second/third safety lights (118C, 120C,122C) are seated in a generally planar front face 119C and are directed straight ahead and thus the axes are parallel. Here, the safety eye light although illustrated with three lights, in other embodiments only one safety light (i.e. 112A) is included however any plurality of lights may be used in a single eye-light body 113. FIG. 9 illustrates two or more fixed safety lights. In this example a first safety light 118D, a second safety light 120D, and a third safety light 122D has each safety light directed along divergent axes as indicated by Axis B, Axis C, and Axis D. Note in this embodiment that the front face may assume other profiles besides a single plane, including curved profiles and multi-faceted planes as illustrated here. In each of these examples disclosed herein, the safety lights utilized may have an adjustable light beam varying between omni-directional and uni-directional.

Figure 9B:
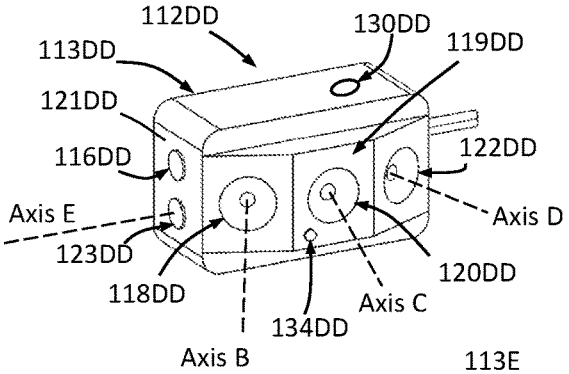
FIG. 9B depicts a perspective view of a safety eye light comprising a plurality of front facing fixed safety lights and a medial facing safety light.

FIG. 9B illustrates yet another embodiment of a safety light. In this embodiment, eye-light body 113DD comprises one or more safety lights disposed on one or more of a front face 119DD and a medial face 121DD. Here, medial safety light 123DD directs light generally along Axis E. This light placement, which may be included in other embodiments of the article of invention, provides additional light at the back of a garage thereby more directly illuminating the floor level at the back of a vehicle parked therein.

Figure 10:
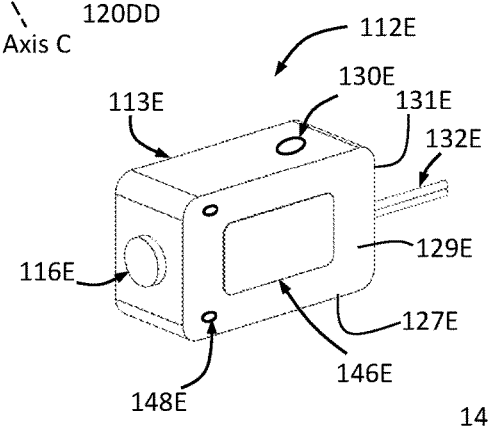
FIG. 10 depicts a back view of a safety eye light comprising a battery compartment for housing a battery.

FIG. 10 illustrates one embodiment of a safety eye light 112E comprising a battery compartment 146E for enclosing a battery therein. Here, the safety lights (on the oppose side) are battery powered. Some safety eye-light bodies 113E include one or more fastening holes 148E for receiving fasteners to secure the first safety eye light 112E to a mount bracket 124. Note also that some embodiments of a safety eye light comprise a wireless control sensor 130E operable to receive wireless signals from a sending unit on an overhead garage door opener or from a remote control causing consequent on/off control a safety light on a safety eye light.

Figure 11:
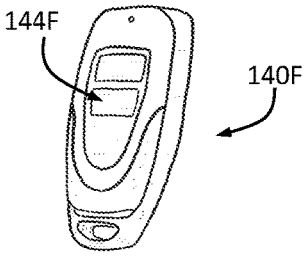
FIG. 11 depicts a perspective view of a keychain style remote control having a programmable (or pre-programed) button for activation and/or inactivation of a safety light of a safety eye light.
Figure 12:
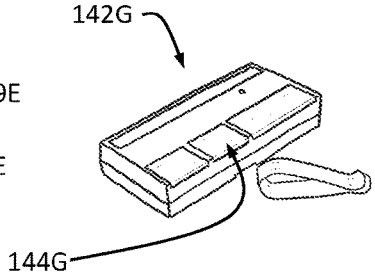
FIG. 12 depicts a perspective view of a visor style remote control having a programmable (or pre-programed) button for activation and/or inactivation of a safety light of a safety eye light.

As illustrated in FIGS. 11-12, a programmable activation button 144F on a key chain remote control 140F may be programmed (or pre-programed) to cause consequent wireless activation of a first safety light 118 on a first safety eye light 112 from a signal received at a wireless control sensor 130. Similarly, a programmable button 144G (or pre-programed) on a visor remote control 142G garage door opener is programmable to also cause consequent activation of a safety light on a safety eye light. The wireless signals are received by wireless control sensors 130 located on either a safety eye light or electric operator in the system.

Figure 13:
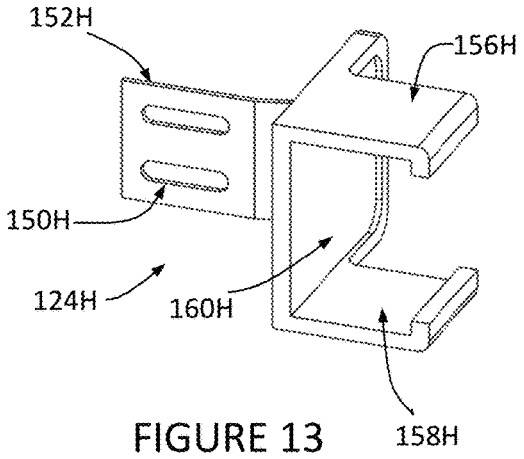
FIG. 13 depicts a perspective view of a mount bracket having slotted fastener holes for coupling with a safety eye light.

FIGS. 13-16 illustrate several examples of mount brackets utilized for securing a safety eye light. The mount brackets of FIG. 13-14 for example, are operable to secure to a first safety eye light to one of a first vertical rail 102 and second vertical rail 104 of a common garage door opening system. FIG. 13 illustrates for example a mount bracket 124H having slotted fastener holes 150H extending through a first leg 152H to facilitate bracket adjustments along a vertical rail. In this embodiment, first leg 152H is generally perpendicular to an eye-light body when captured in capture space 160H. Fasteners 128 extend through slotted fastener holes 150H for fastening against one of the vertical rails 102, 104. A first safety eye light 112 and second safety eye light 114 in some embodiments are captured within a capture space 160 illustrated in these embodiments as defined by an opposing first capture leg 156H and second capture leg 158H. The capture may be by friction fit. In alternative embodiments, one or more fastener holes 148 (i.e. 148K) extend through the body of mount bracket 124 to facilitate the use of screws to hold a safety eye light therein.

Figure 14:
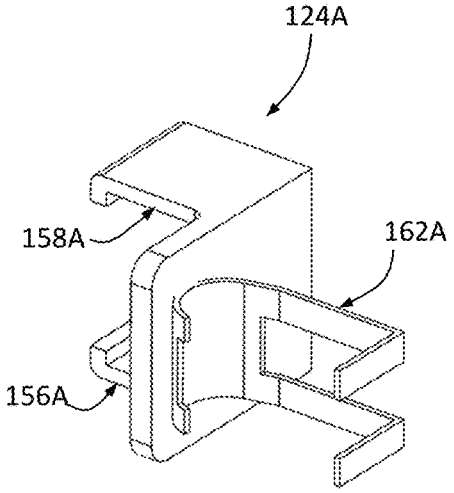
FIG. 14 depicts a perspective view of a mount bracket having a deflectable clamp for coupling with a safety eye light.
Figure 15:
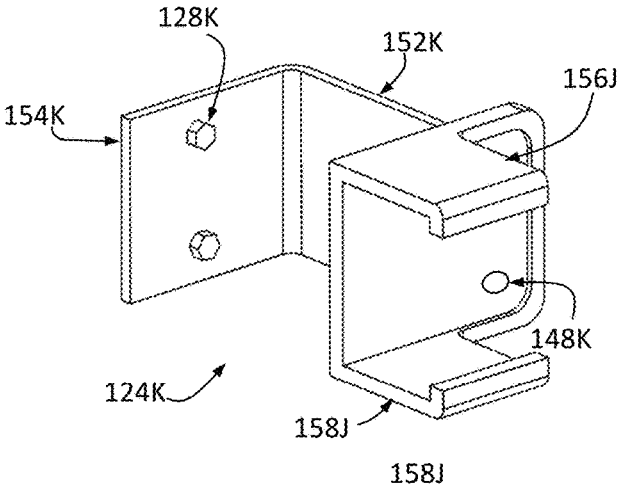
FIG. 15 depicts a perspective view of a mount bracket having a base leg extending generally parallel to a capture space.
Figure 16:
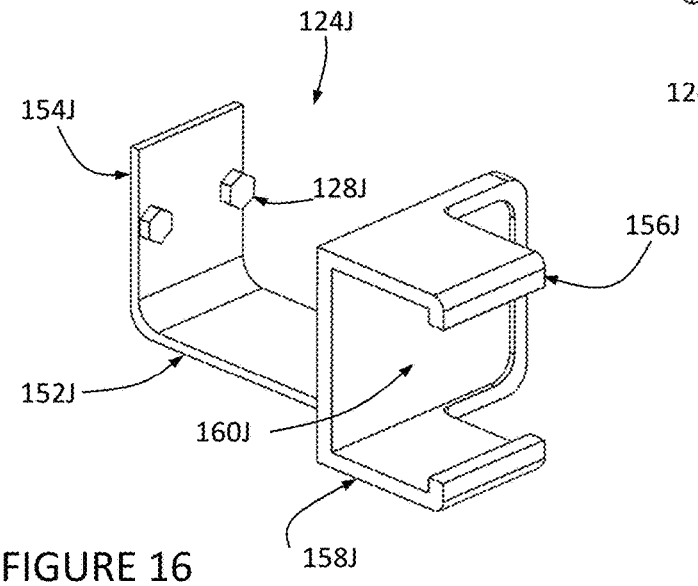
FIG. 16 depicts a perspective view of a mount bracket having a bendable leg generally parallel to the floor.

FIG. 14 illustrates one embodiment of a mount bracket 124A comprising a C-shaped deflectable clamp 162A formed to deflect then fit about the body of a vertical rail and operable to secure to the vertical rail by friction. FIGS. 15 and 16 illustrate example embodiments of mount brackets operable to secure a safety eye light to a vertical frame or wall of a space using one or more fasteners. In FIG. 15, base leg 154K extends generally parallel to capture space 160K from first leg 152K thereby facilitating alignment of the opposing safety eyes. First leg 152J of the FIG. 16 embodiment is situated generally parallel to the floor and is bendable for directing the illumination path of a safety light of a safety eye light up or down in the absence of adjustable safety light.

FIGS. 17-19 illustrates just a few examples of safety light directional placement across a floor within a space such as a garage. For example, in FIG. 17, the safety lights of a first safety eye light 112 and a second safety eye light 114 are directed across a floor predominantly towards the side walls of the garage. On the other hand, in FIG. 18, the safety lights of safety eye lights are directed to spread towards both the walls and across the floor including the center of a garage. In yet another example, the safety light(s) of a first safety eye light have different illumination directions across a floor than safety light(s) on a second safety eye light. In most embodiments, the safety light is positioned whereby it illuminates at the floor level at the rear of vehicles such as from a medial face. This lighting position is helpful when removing items such as groceries from the trunk of a vehicle whereby the user ambulates along the side of the vehicle where obstacles such as snow blowers, bicycles, and other objects may be stored.

Figure 20:
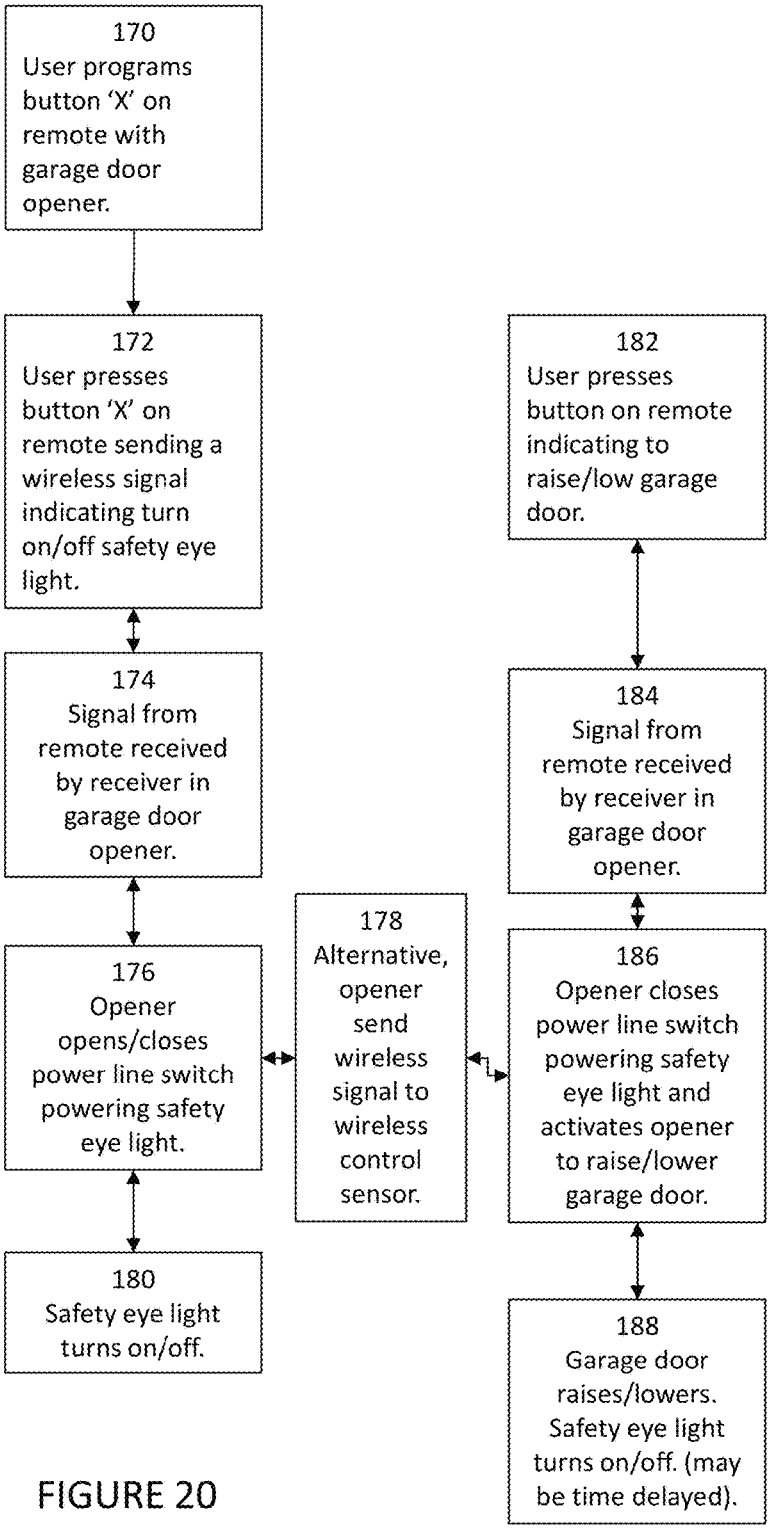
FIG. 20 depicts a flow chart of a method to operate a safety light on a safety eye light.
Figure 21:
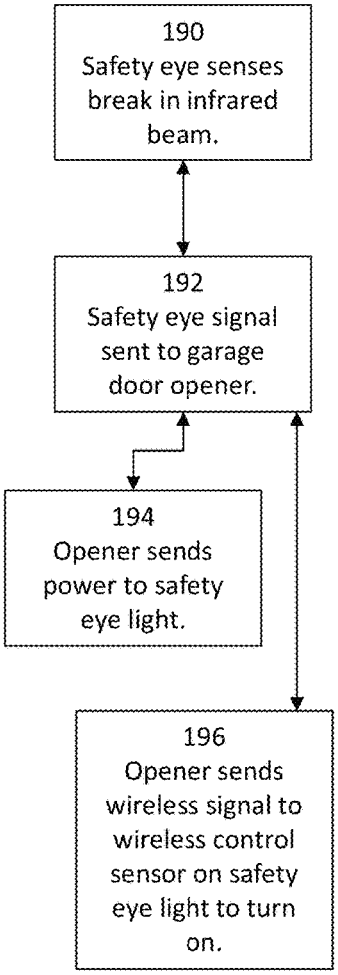
FIG. 21 depicts a flow chart of a method to operate a safety light on a safety eye light.

In one embodiment, a method of operating a safety light on a safety eye light comprises the following steps as illustrated in FIG. 20. A user programs button referred to as 'X' on a remote control (i.e. FIG. 11, 12) associated with a garage door opener 100 for activation of a safety light on a safety eye light (step 170). Alternatively, the button may be pre-programed. The remote control may be in a variety of forms including a key chain remote 140F, a visor remote 142G, a remote integrated into a vehicle, and an indoor/outdoor wall mounted remote. The user presses button 'X' on the associated remote indicating to turn on/off a safety light of a safety eye light associated with the garage door opener (step 172). The wireless signal from the remote control associated with pressing button 'X' is received by a receiver (wireless control sensor) in the garage door opener (step 174) causing consequent opening or closing of a power line switch powering the safety eye light (step 176). The safety eye light turns on/off (step 180). Alternatively, the garage door opener sends a wireless signal (step 178) to a wireless control sensor on the safety eye light causing consequent activation/deactivation of the safety light.

In yet another embodiment, a method of operating a safety light on a safety eye light comprises the following steps. The user presses a button on a remote control associated with a garage door opener indicating to raise/lower the garage door (step 182). Again, the remote control may be in a variety of forms including a key chain remote, a visor remote, a remote integrated into a vehicle, and an indoor/outdoor wall mounted remote. The signal from the remote is received by a receiver (wireless control sensor) in the garage door opener (step 184). This causes a consequent action by the opener of closing a power line switch thereby powering the safety eye light(s) and activating the garage door opener to raise or lower the garage door (step 186). The garage door raises/lowers then the safety light turns on/off. Alternatively, the garage door opener may send a wireless signal to the wireless control sensor (step 178) thereby activating the safety light to turn on or off. When complete, the safety eye light turns off or may be timed delayed allowing for example an occupant time to walk into the house (step 188).

In another embodiment of a method of operating a safety light on a safety eye light comprises the following steps. A safety eye of a safety eye light senses a break in the infrared light beam (step 190). A safety eye signal is sent to the garage opener (step 192) consequently causing the power to be sent from the garage door opener to the safety light on the safety eye light (step 194) changing the safety eye light from a state of dis-illumination to a state of illumination. Alternatively, the opener sends a wireless signal to the wireless control sensor of the safety eye light to turn the safety light on (step 196).

It is noted that the terms "substantially" and "about" and "generally" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

The foregoing invention has been described in accordance with the relevant legal standards, thus the description is exemplary rather than limiting in nature. Variations and modifications to the disclosed embodiment may become apparent to those skilled in the art and fall within the scope of the invention.

The invention claimed is:

1. A safety eye light operable to provide additional lighting in a garage when mounted at a garage door entry comprising:

a first eye-light body configured to house components of a safety eye light therein;

a first safety eye housed in said first eye-light body operable to at least one of generate and sense an infrared beam;

a first safety light housed in said first eye-light body operable to create a source of light emitted from said safety so as to direct illumination towards a garage door entrance area when said first eye-light body is secured at the garage door entry; and wired communication extending from said first eye-light body operable to communicate with an electric operator of a garage door opening system distanced from said first eye-light body.

2. The safety eye light of claim 1 whereas said first safety light is directed from a front facing face of said safety eye light.

3. The safety eye light of claim 1 whereas said first safety light is fixed on a front facing face of said safety eye light.

4. The safety eye light of claim 1 whereas said first safety light is directionally adjustable.

5. The safety eye light of claim 1 further comprising a medial safety light on a medial facing face of said safety eye light.

6. The safety eye light of claim 1 further comprising:

a second safety light on said first eye-light body; and whereas said first safety light and said second safety light have axes of illumination that are non-parallel.

7. The safety eye light of claim 1 further comprising:

a second safety light on said first eye-light body; and whereas said first safety light and said second safety light have axes of illumination that are parallel.

8. The safety eye light of claim 1 whereas said first eye-light body comprises a motion sensor operable to activate said first safety light upon sensing movement in a garage.

9. The safety eye light of claim 1 whereas said first eye-light body comprises a wireless control sensor operable to receive signals from a remote control device operable to at least one of activate and inactivate said safety eye light.

10. The safety eye light of claim 1 whereas said first eye-light is activated by depressing an activation button on at least one of a: wall mounted control, a visor remote control, and a key chain remote control.

11. A safety eye light system operable to provide additional lighting in a garage when mounted at a garage door entry comprising:

a first eye-light body operable to house components of a safety eye light therein;

a second eye-light body operable to house components of a safety eye light;

a first safety eye housed in said first eye-light body operable to at least one of generate and receive an infrared light beam;

a second safety eye housed in said second eye-light body operable to at least one of generate and receive an infrared light beam;

said first safety eye and said second safety eye cooperatively operating as generator and receiver of said infrared light beam;

one or more of a first safety light housed in said first eye-light body and a second safety light housed in said second eye-light body operable to create a source of light emitted from said safety eye lights so as to direct illumination towards a garage door entrance area; and wired communication extending from said first eye-light body operable to communicate with an electric operator of a garage door opening system.

12. The safety eye lights of claim 11 whereas at least one of said first safety light and said second safety light is directed from a front facing face of respective first and second eye-light bodies.

13. The safety eye lights of claim 11 whereas said first safety light is fixed on a front facing face of said first safety eye light and said second safety light is fixed on a front facing surface of said second safety eye light.

14. The safety eye light of claim 11 whereas at least one of said first safety light on said first safety eye-light body and said second safety light on said second eye-light body is directionally adjustable.

15. The safety eye light of claim 11 whereas at least one of said first eye-light body and said second eye-light body comprises a medial safety light.

16. The safety eye light of claim 11 whereas said first safety light in a first safety eye light and a first safety light in a second safety eye light have axes of illumination that are directed in a lateral direction.

17. The safety eye light of claim 11 whereas said first safety light in a first safety eye light and a first safety light in a second safety eye light have axes of illumination that are directed to illuminate across the floor a garage center and side walls.

18. The safety eye light of claim 11 whereas at least one of said first eye-light body and said second eye-light body comprises a motion sensor operable to activate said first safety light and second safety light upon sensing movement in a garage.

19. The safety eye light of claim 11 whereas at least one of a first eye-light body and a second eye-light body comprises a wireless control sensor operable to receive signals from a remote control device to consequently at least one of activate and inactivate at least one of said first safety light and said second safety light.

20. A method of operating a safety light in a safety eye light mounted at a garage door entry comprising the steps of:

obtaining a garage door opener system comprising at least an electric operator, a remote control, and a safety eye light having an eye-light body with a safety light and a safety eye housed therein and whereby at least one of the electric operator and safety eye light comprises a wireless control sensor;

at least one of programing and pre-programing a button on said remote control to send a wireless signal; and receiving said wireless signal by said wireless control sensor causing consequent at least one of opening and closing a light power line switch in electrical communication with the safety light housed in the safety eye light resulting in consequent illumination or dis-illumination of said safety light at said garage door entry.

* * * * *